US010669507B2

(12) United States Patent
Ushioda

(10) Patent No.: US 10,669,507 B2
(45) Date of Patent: Jun. 2, 2020

(54) FUEL ECONOMY ENGINE OIL COMPOSITION

(71) Applicant: Chevron Japan Ltd., Minato-ku (JP)

(72) Inventor: Nobuo Ushioda, Omaezaki (JP)

(73) Assignee: CHEVRON JAPAN LTD., Minato-ku (JP)

( * ) Notice: Subject to any disclaimer, the term of this patent is extended or adjusted under 35 U.S.C. 154(b) by 0 days.

(21) Appl. No.: 15/355,432

(22) Filed: Nov. 18, 2016

(65) Prior Publication Data

US 2017/0066991 A1 Mar. 9, 2017

Related U.S. Application Data

(63) Continuation of application No. 14/488,347, filed on Sep. 17, 2014, now abandoned.

(60) Provisional application No. 61/881,249, filed on Sep. 23, 2013.

(51) Int. Cl.

| | |
|---|---|
| ***C10M 139/00*** | (2006.01) |
| ***C10M 141/10*** | (2006.01) |
| ***C10M 163/00*** | (2006.01) |
| ***C10M 141/08*** | (2006.01) |
| ***C10M 101/02*** | (2006.01) |
| ***C10M 129/08*** | (2006.01) |
| ***C10M 129/54*** | (2006.01) |
| ***C10M 133/12*** | (2006.01) |
| ***C10M 133/44*** | (2006.01) |
| ***C10M 135/10*** | (2006.01) |
| ***C10M 137/10*** | (2006.01) |

(52) U.S. Cl.

CPC ..... *C10M 141/10* (2013.01); *C10M 101/02* (2013.01); *C10M 129/08* (2013.01); *C10M 129/54* (2013.01); *C10M 133/12* (2013.01); *C10M 133/44* (2013.01); *C10M 135/10* (2013.01); *C10M 137/10* (2013.01); *C10M 141/08* (2013.01); *C10M 163/00* (2013.01); *C10M 2203/1006* (2013.01); *C10M 2203/1025* (2013.01); *C10M 2207/022* (2013.01); *C10M 2207/026* (2013.01); *C10M 2207/262* (2013.01); *C10M 2207/289* (2013.01); *C10M 2209/084* (2013.01); *C10M 2215/064* (2013.01); *C10M 2215/08* (2013.01); *C10M 2215/223* (2013.01); *C10M 2215/28* (2013.01); *C10M 2219/046* (2013.01); *C10M 2223/045* (2013.01); *C10N 2220/022* (2013.01); *C10N 2220/033* (2013.01); *C10N 2230/02* (2013.01); *C10N 2230/06* (2013.01); *C10N 2230/40* (2013.01); *C10N 2230/54* (2013.01); *C10N 2230/68* (2013.01); *C10N 2240/10* (2013.01)

(58) Field of Classification Search

CPC ..... C10M 129/50; C10M 129/08
USPC ..... 508/198
See application file for complete search history.

(56) References Cited

U.S. PATENT DOCUMENTS

| | | | |
|---|---|---|---|
| 2,992,708 | A | 7/1961 | Lyon |
| 3,018,250 | A | 1/1962 | Anderson |
| 3,018,291 | A | 1/1962 | Anderson |
| 3,024,237 | A | 3/1962 | Drummond |
| 3,100,673 | A | 8/1963 | Ulmer |
| 3,172,892 | A | 3/1965 | Le Suer |
| 3,202,678 | A | 8/1965 | Stuart |
| 3,219,666 | A | 11/1965 | Norman |
| 3,272,746 | A | 9/1966 | Le Suer |
| 3,361,673 | A | 1/1968 | Stuart |
| 3,381,022 | A | 4/1968 | Le Suer |
| 3,778,375 | A | 12/1973 | Braid |
| 3,779,928 | A | 12/1973 | Schlicht |
| 3,912,764 | A | 10/1975 | Palmer, Jr. |
| 3,932,290 | A | 1/1976 | Koch |
| 3,933,659 | A | 1/1976 | Lyle |
| 4,105,571 | A | 8/1978 | Shaub |
| 4,152,499 | A | 5/1979 | Boerzel |
| 4,234,435 | A | 11/1980 | Meinhardt |
| 4,331,222 | A | 5/1982 | Liston |
| 4,406,803 | A | 9/1983 | Liston |
| 4,530,771 | A | 7/1985 | Nakano |
| 4,612,132 | A | 9/1986 | Wollenberg |
| 4,702,859 | A | 10/1987 | Shimizu |
| 4,746,446 | A | 5/1988 | Wollenberg |

(Continued)

FOREIGN PATENT DOCUMENTS

| | | | |
|---|---|---|---|
| CN | 101517047 | A | 8/2009 |
| CN | 102209770 | A | 10/2011 |

(Continued)

OTHER PUBLICATIONS

Encyclopedia of Chemical Technology, Kirk-Othmer, vol. 5, pp. 898-905 (Interscience Publishers, New York, 1950).

*Primary Examiner* — Prem C Singh
*Assistant Examiner* — Francis C Campanell
(74) *Attorney, Agent, or Firm* — Carlton Virassammy

(57) ABSTRACT

The present invention is directed to a lubricating oil additive containing a vicinal diol and a particular detergent blend typically is low viscosity base oils whereby exhibiting improved fuel economy. In this respect, disclosed is a lubricating oil composition comprising: a major amount of base oil of lubricating viscosity; a friction modifier which is selected from the group consisting of $C_{10}$-$C_{30}$ alkane 1,2-diols and $C_{10}$-$C_{30}$ alkene 1,2-diols; an overbased alkyl alkaline earth metal hydroxybenzoate detergent having a metal ratio less than 3.0; and an overbased alkyl calcium sulfonate or an overbased alkyl calcium hydroxybenzoate having a metal ratio of 3.5 or greater.

11 Claims, No Drawings

(56) References Cited

U.S. PATENT DOCUMENTS

| | | | | |
|---|---|---|---|---|
| 4,747,965 | A | 5/1988 | Wollenberg | |
| 5,112,507 | A | 5/1992 | Harrison | |
| 5,137,978 | A | 8/1992 | Degonia | |
| 5,137,980 | A | 8/1992 | Degonia | |
| 5,175,225 | A | 12/1992 | Ruhe, Jr. | |
| 5,241,003 | A | 8/1993 | Degonia | |
| 5,266,186 | A | 11/1993 | Kaplan | |
| 5,286,799 | A | 2/1994 | Harrison | |
| 5,319,030 | A | 6/1994 | Harrison | |
| 5,334,321 | A | 8/1994 | Harrison | |
| 5,356,552 | A | 10/1994 | Harrison | |
| 5,523,417 | A | 6/1996 | Blackborow | |
| 5,565,528 | A | 10/1996 | Harrison | |
| 5,616,668 | A | 4/1997 | Harrison | |
| 5,625,004 | A | 4/1997 | Harrison | |
| 5,716,912 | A | 2/1998 | Harrison | |
| 5,777,025 | A | 7/1998 | Spencer | |
| 5,792,729 | A | 8/1998 | Harrison | |
| 6,191,081 | B1 * | 2/2001 | Cartwright | C10M 159/20 508/391 |
| 2003/0191032 | A1 * | 10/2003 | Deckman | C10M 159/20 508/460 |
| 2007/0027057 | A1 | 2/2007 | Le Coent | |
| 2010/0081594 | A1 * | 4/2010 | Walker | C10M 141/08 508/287 |
| 2012/0071375 | A1 | 3/2012 | Yaguchi | |
| 2012/0129741 | A1 * | 5/2012 | Dunning | C10M 107/02 508/110 |

FOREIGN PATENT DOCUMENTS

| | | |
|---|---|---|
| CN | 103215108 A | 7/2013 |
| EP | 542 380 | 5/1993 |
| EP | 602 863 | 6/1994 |
| EP | 355 895 | 2/2000 |
| EP | 2610333 | 7/2013 |
| JP | 2000-017283 | 1/2000 |
| JP | 2000-273481 | 10/2000 |
| WO | 2010/115864 | 10/2010 |
| WO | 2011/007643 | 1/2011 |
| WO | 2013/074498 | 5/2013 |

* cited by examiner

FUEL ECONOMY ENGINE OIL COMPOSITION

This application is a continuation of and claims priority to U.S. patent application Ser. No. 14/488,347 which was filed on Sep. 17, 2014.

FIELD OF THE INVENTION

Disclosed is lubricating oil composition having a particular vicinal diol friction modifier and detergent mixture having at least two types of metallic detergents. The lubricating oil composition demonstrates improved friction characteristics and is particularly suited for low-viscosity lubricating oil compositions.

BACKGROUND

Due to the combination of global regulations promoting fuel efficiency and market demand, fuel economy has driven engine builders to adopt changes to design (engines with smaller tolerances, smaller displacement, direct fuel injection, turbochargers, boosted intakes, start/stops, etc.). Additionally, hardware technology including fuel-electric hybrid and idling stop with engine design modification has placed important new performance requirements on motor oils for passenger cars. Not only must the motor oil address these added design effects, the engine oils are also viewed as an area where additional performance may be achieved. Notably, fuel economy performance of a lubricant is affected by both the viscosity of the oil and additive interactions.

Of the two factors, viscosity has long been regarded as resulting in greater friction reduction and fuel economy. Moving to a lower viscosity engine oil has been a recognized strategy to improve vehicle fuel economy. Recently it has been discovered that this trend does not hold as oils are developed with viscosities that are far lower than those considered previously and thus cannot be read across. For example, moving from an SAE viscosity grade 10W-30 oil to a 5W-30 viscosity oil results in the expected improvement in fuel economy when utilizing the same chemistry in the formulation, but moving to 0W-20 or lower has not demonstrated this trend. One explanation is that this is the result of increased friction in what are known as boundary lubrication situations. These boundary lubrication situations are found when an engine is running at low speed and high temperature. The lower viscosity oils may be less able to maintain separation between moving parts in the engine resulting in increased friction and lowering fuel economy. In addition, as lubricants become thinner, concerns about engine wear increase.

The use of appropriate additive systems is becoming increasingly important. Additives in lubricants often include polar functional groups which will draw the additive to the metal surfaces in an engine. As a result of this interaction, many additives are known to modify the friction performance of a lubricant. Some additives, like detergents, are known to have a negative effect on fuel economy by increasing friction. Balancing the interactions of the additives in the lubricant; and the benefits/potential drawbacks of lowered viscosity is a challenge for today's formulators.

Herein, it is has been shown that certain combinations of detergents and vicinal diol friction modifiers have been discovered which show increased fuel economy benefits in conventional oil and more particularly low viscosity oils of lubricating viscosity. These benefits have been demonstrated through both bench and engine testing.

Vicinal diols are known in the art to be employed in lubricating oils. U.S. Pat. No. 4,406,803 teaches the use of $C_{10}$-$C_{30}$ alkane 1,2-diols as friction modifiers in lubricants for internal combustion engines. U.S. Pat. No. 4,331,222 teaches the use of $C_8$-$C_{28}$ alkane 1,2-diols in functional fluids, particularly those for tractors, to reduce brake noise. JP 2000-017283 teaches the use of greater than $C_5$ alkane 1,2-diols as lubricity agents. JP 2000-273481 teaches the combination of $C_{14}$-$C_{22}$ alkane 1,2-diols with a detergent having total base number greater than 60 in a base oil with viscosity index of 80-150 for lubrication. WO 2010/115864 teaches the use of $C_{10}$-$C_{24}$ diols in functional fluids particularly for wet brakes. WO 2011/007643 teaches the combination of alkane or alkene 1,2-diols and zinc dithiophosphates in lubricants for improved fuel economy. The class of friction modifiers that includes alkane/alkene 1,2-diols has been in use for decades. However, none of the lubricants previously described address the problem of friction modification in very low viscosity engine oils.

SUMMARY

An aspect of the present invention is directed to a lubricating oil additive containing a vicinal diol and a particular detergent blend typically is low viscosity base oils whereby exhibiting improved fuel economy. In this respect, disclosed is a lubricating oil composition comprising: a major amount of base oil of lubricating viscosity; a friction modifier which is selected from the group consisting of $C_{10}$-$C_{30}$ alkane 1,2-diols and $C_{10}$-$C_{30}$ alkene 1,2-diols; an overbased alkyl alkaline earth metal hydroxybenzoate detergent having a metal ratio less than 3.0; and an overbased alkyl calcium sulfonate or an overbased alkyl calcium hydroxybenzoate having a metal ratio of 3.5 or greater. In a further aspect, the alkaline earth metal is calcium.

An aspect is directed to lubricating oil compositions wherein the vicinal diol friction modifier is selected from the formula $R_1$—$CH(OH)CH_2(OH)$ wherein $R_1$ is alkyl containing from 10 to 28 carbon atoms. More particularly disclosed are wherein the friction modifier is a $C_{10}$-$C_{30}$ alkane 1,2-diol derived from a linear alkyl containing from 14 to 18 carbon atoms. In this regard the friction modifier is typically employed in an amount from about 0.02 to about 5.0 wt. % based upon the total weight of the lubricating oil composition.

An aspect is directed to a lubricating oil composition comprising: a major amount of base oil of lubricating viscosity; a friction modifier which is selected from the group consisting of $C_{10}$-$C_{30}$ alkane 1,2-diols and $C_{10}$-$C_{30}$ alkene 1,2-diols; an overbased alkyl alkaline earth metal hydroxybenzoate detergent having a metal ratio less than 3.0 has an alkyl chain length of 14 to 18 carbon atoms; and an overbased alkyl calcium sulfonate or an overbased alkyl calcium hydroxybenzoate having a metal ratio of 3.5 or greater. In a further aspect, the alkyl chain is linear alkyl. In a further aspect the alkaline earth metal is selected from calcium.

An aspect is directed to a lubricating oil composition comprising: a major amount of base oil of lubricating viscosity; a friction modifier which is selected from the group consisting of $C_{10}$-$C_{30}$ alkane 1,2-diols and $C_{10}$-$C_{30}$ alkene 1,2-diols; an overbased alkyl alkaline earth metal hydroxybenzoate detergent having a metal ratio less than 3.0; and an overbased alkyl calcium sulfonate or an overbased alkyl calcium hydroxybenzoate having a metal ratio of 3.5 or greater has an alkyl chain length of 20 to 28 carbon atoms. In a further aspect the detergent having a metal ratio of 3.5 or greater is an overbased alkyl calcium hydroxybenzoate; in another aspect the detergent having a metal ratio of 3.5 or greater is an overbased alkyl calcium sulfonate.

An aspect of the present invention is directed to the features of the base oil, thus in one regard the base oil of lubricating viscosity has a viscosity index of greater than 110. More particularly, the base oil of lubricating oil is selected to have a HTHS viscosity of less than 2.9 mPa·s at 150° C. as determined by ASTM D4683. Such other features of the base oil and additives may be so selected such that the lubricating oil composition is formulated to meet SAE viscosity grade 0W20. Lower viscometrics in the selection of suitable base oils has provided improvement frictional characteristics of the lubricating composition of the present invention, thus one aspect is directed to wherein the lubricating oil composition may have a base oil of lubricating oil having a HTHS viscosity of less than 2.6 mPa·s at 150° C. as determined by ASTM D4683 and even wherein the base oil of lubricating oil has a HTHS viscosity of less than 2.3 mPa·s at 150° C. as determined by ASTM D4683. In this regard, the lubricating oil composition may be formulated to contain less than 3 wt % of viscosity index improver component. In a further aspect, the lubricating composition contains substantially no viscosity index improver component.

An aspect of the present invention is directed to a fuel economical lubricating oil composition particularly suited for lubricating internal combustion engines such as diesel engines, gasoline engines, and gas engines mounted on land traveling vehicles. In this regard, disclosed is a lubricating oil composition for internal combustion engines comprising: a major amount of base oil of lubricating viscosity; a $C_{10}$-$C_{30}$ hydrocarbyl 1,2-diol in an amount from about 0.1 to 3 mass %; an overbased alkyl ($C_{14}$-$C_{18}$) alkaline earth metal hydroxybenzoate detergent having a metal ratio less than 3.0 in an amount from about 0.01 to 0.4 mass % based on alkaline earth metal; an overbased alkyl ($C_{20}$-$C_{28}$) calcium sulfonate or an overbased alkyl ($C_{20}$-$C_{28}$) calcium hydroxybenzoate having a metal ratio of 3.5 or greater in an amount from 0.01 to 0.4 mass % based on calcium; a nitrogen containing dispersant in terms of nitrogen content from about 0.01 to 0.3 mass %; a zinc dialkydithiophosphate in the amount from 0.01 to 0.1% in terms of phosphorous content; an oxidation inhibitor selected from the group consisting of a phenolic antioxidant or a diphenyl amine type antioxidant (or mixtures thereof) in the amount from 0.1 to 7 mass %; and wherein the mass % is based upon the total amount of the lubricating oil composition.

DETAILED DESCRIPTION

The term "alkali metal" or "alkaline metal" refers to lithium, sodium or potassium.

The term "alkaline earth metal" refers to calcium, barium, magnesium and strontium.

The term "alkaline earth alkylaryl sulfonate" refers to an alkaline earth metal salt of an alkylaryl sulfonic acid. In other words, it is an alkaline earth metal salt of an aryl that is substituted with (1) an alkyl group and (2) a sulfonic acid group that is capable of forming a metal salt.

The term "alkyl" refers to both straight- and branched-chain alkyl groups.

The term "alkylphenate" means a metal salt of an alkylphenol.

The term "alkylphenol" means a phenol having one or more alkyl substituents, wherein at least one of the alkyl substituents has a sufficient number of carbon atoms to impart oil solubility to the phenol.

The term "aryl group" is a substituted or non-substituted aromatic group, such as the phenyl, tolyl, xylyl, ethylphenyl and cumenyl groups.

The term "calcium base" refers to a calcium hydroxide, calcium oxide, calcium alkoxides, and the like, and mixtures thereof.

The term "hydrocarbyl" means a group or radical that contains carbon and hydrogen atoms and that is bonded to the remainder of the molecule via a carbon atom. It may contain hetero atoms, i.e. atoms other than carbon and hydrogen, provided they do not alter the essentially hydrocarbon nature and characteristics of the group. As examples of hydrocarbyl, there may be mentioned alkyl and alkenyl.

The term "hydrocarbyl phenol" refers to a phenol having one or more hydrocarbyl substituent; at least one of which has sufficient number of carbon atoms to impart oil solubility to the phenol.

The term "lime" refers to calcium hydroxide, also known as slaked lime or hydrated lime.

The term "metal" means alkali metals, alkaline earth metals, or mixtures thereof.

The term "metal base" refers to a metal hydroxide, metal oxide, metal alkoxides and the like and mixtures thereof, wherein the metal is selected from the group consisting of lithium, sodium, potassium, magnesium, calcium, strontium, barium or mixtures thereof.

The term "overbased" refers to a class of metal salts or complexes. These materials have also been referred to as "basic", "superbased", "hyperbased", "complexes", "metal complexes", "high-metal containing salts", and the like. Overbased products are metal salts or complexes characterized by a metal content in excess of that which would be present according to the stoichiometry of the metal and the particular acidic organic compound reacted with the metal, e.g., a carboxylic acid.

The term "phenate" means a metal salt of a phenol.

The term "Total Base Number" or "TBN" refers to the equivalent number of milligrams of KOH needed to neutralize 1 gram of a product. Therefore, a high TBN reflects strongly overbased products and, as a result, a higher base reserve for neutralizing acids. The TBN of a product can be determined by ASTM Standard No. D2896 or equivalent procedure.

The term "SAE J300" refers to SAEJ300: "Engine Oil Viscosity Classification" January 2009 version.

Hydrocarbyl Diol:

The hydrocarbyl diols contemplated for use in this invention are hydrocarbyl diols having vicinal hydroxyls. They have the formula: R—$(OH)_2$ wherein R is a hydrocarbyl group containing 10 to 30 carbon atoms, including mixtures thereof. R can be linear or branched, saturated or unsaturated. Particularly, R is straight chain alkyl or alkene group wherein the alkene group has two or less unsaturated bonds, a single unsaturated bond. The two hydroxyl groups are preferably near the end of the hydrocarbyl chain and are on adjacent carbon atoms (vicinal).

As disclosed hereinabove, the preferred vicinal diols contain 10 to 30 carbon atoms. This range is preferred because diols having much less than 10 or 12 carbon atoms have significantly less friction reducing properties, while in those having more than 30 carbon atoms, solubility constraints become significant. More preferred are the $C_{14}$ to $C_{18}$ hydrocarbyl groups and mixtures of such hydrocarbyl groups in which solubility, frictional characteristics and other properties appear to be maximized.

A more preferred vicinal diols are represented by alkane-1,2-diols of the formula $R_1$—$CH(OH)CH_2(OH)$ wherein $R_1$ is alkyl containing from 8 to 28 carbon atoms, or mixtures thereof. Straight and branched chain alkyl groups may be employed. Particularly useful are linear olefins or blends of linear olefins, are terminal olefins, as contrasted to internal olefins. The preferred linear olefins are alpha olefins fractions having a major amount of n-alpha olefins. As used herein, major amount refers to greater than about 50 wt % n-alpha olefin, and preferably greater than about 80 wt %. Examples of the alpha-olefins include 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available alpha-olefin fractions that can be used include the C15-18 alpha-olefins, C12-16 alpha-olefins, C14-16 alpha-olefins, C14-18 alpha-olefins, C16-18 alpha-olefins, C16-20 alpha-olefins, C18-24 alpha-olefins, C20-24 alpha-olefins, C22-28 alpha-olefins, C24-28 alpha-olefins, C26-28 alpha-olefins, etc. Suitable n-alpha olefins can be derived from the ethylene chain growth process. This process yields even numbered straight chain 1-olefins from a controlled Ziegler polymerization. Non-Ziegler ethylene chain growth oligomerization routes are also known in the art. Other methods for preparing the alpha olefins of this invention include wax cracking as well as catalytic dehydrogenation of normal paraffins. However, these latter processes typically require further processing techniques to provide a suitable alpha olefin carbon distribution.

Single carbon number species may be employed such as decane-1,2-diol, octadecane-1,2-diol, eicosane-1,2-diol, tricontane-1,2-diol, and the like, but a blend of several carbon numbers is preferred. Typical blends include the 1,2-diols of 10 to 30 (incl.) carbon atom alkanes; the 1,2-diols of 12, 14, 16, 18 and 20 carbon atom alkanes; the 1,2-diols of 15 to 20 (incl.) carbon atom alkanes; the 1,2-diols of 15 to 18 (incl.) carbon atom alkanes; the 1,2-diols of 20 to 24 (incl.) carbon atom alkanes; the 1,2-diols of 24, 26 and 28 carbon atom alkanes; the 1,2-diols of 16 to 18 (incl.) carbon atom alkanes; and the like.

The diols useful for this invention are either commercially available or are readily prepared from the corresponding 1-olefin by methods well known in the art. For example, the olefin is first reacted with peracid, such as peroxyacetic acid or hydrogen peroxide plus formic acid to form an alkane-1,2-epoxide which is readily hydrolyzed under acid or base catalysis to the alkane-1,2-diol. In another process, the olefin is first halogenated to a 1,2-dihalo-alkane and subsequently hydrolyzed to an alkane-1,2-diol by reaction first with sodium acetate and then with sodium hydroxide. Vicinal diols can also be prepared by the peroxytrifluoroacetic acid method for the hydroxylation of other procedures are well know and can be found in U.S. Pat. Nos. 2,411,762; 2,457,329 and 2,455,892. The diols can also be prepared via catalytic epoxidation of an appropriate olefin, followed by hydrolysis.

Particularly preferred diols contemplated are 1,2-decanediol, 1,2-dodecanediol, 1,2-tetradecanediol, 1,2-pentadecanediol, 1,2-hexadecanediol, 1,2-heptadecanediol, 1,2-octadecanediol, etc. mixed 1,2-$C_{15}$-$C_{18}$ alkanediols, mixed 1,2-$C_{13}$-$C_{16}$ alkanediols, mixed 1,2-$C_{16}$-$C_{18}$ alkanediols, and mixtures of all such diols, including mixtures of similar diols. Other suitable diol are derived from the C12-16 alpha-olefins, C14-16 alpha-olefins, C14-18 alpha-olefins, and C16-20 alpha-olefins commercial fractions.

Detergent Mixture:

The detergent mixture comprising at least a first overbased metal hydrocarbyl-substituted hydroxybenzoate having a metal ratio of less than or equal to 3. Also included in the detergent mixture is a second metal detergent which is different from the first detergent, having a metal ratio of greater than or equal to 3.5. The second detergent is either an overbased metal hydrocarbyl-substituted hydroxybenzoate or an overbased metal alkyl aryl sulfonate.

The overbased metal hydrocarbyl-substituted hydroxybenzoate typically has the structure shown:

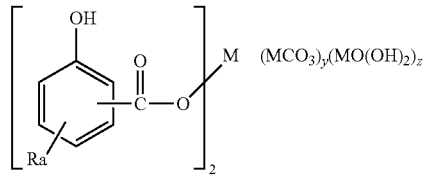

wherein $R_a$ is a linear aliphatic group, branched aliphatic group or a mixture of linear and branched aliphatic groups. There may be more than on $R_a$ group attached to the benzene ring, however dialkyl attachment is less than 5% and is not expected to alter performance. Preferably, $R_a$ is an alkyl or alkenyl group. More preferably, $R_a$ is a straight or branched chain alkyl group from 9 to 40 carbon atoms. When $R_a$ is a linear aliphatic group, the linear alkyl group typically comprises from about 12 to 40 carbon atoms, more preferably from about 14 to 30 carbon atoms. When $R_a$ is a branched aliphatic group, the branched alkyl group typically comprises at least 9 carbon atoms preferably from about 9 to 24 carbon atoms and most preferably from about 10 to 18 carbon atoms. Such branched aliphatic groups are preferably derived from an oligomer of propylene or butene.

$R_a$ can also represent a mixture of linear or branched aliphatic groups. When $R_a$ represents a mixture of aliphatic groups, the alkaline-earth metal alkylhydroxybenzoic acid employed in the present invention may contain a mixture of linear groups, a mixture of branched groups, or a mixture of linear and branched groups. Thus, $R_a$ can be a mixture of linear aliphatic groups, preferably alkyl; for example, an alkyl group selected from the group consisting of $C_{14}$-$C_{16}$, $C_{14}$-$C_{18}$, $C_{16}$-$C_{18}$, $C_{18}$-$C_{20}$, $C_{20}$-$C_{22}$, $C_{20}$-$C_{24}$ and $C_{20}$-$C_{28}$ alkyl and mixtures thereof and derived from normal alpha olefins. Advantageously, these mixtures include at least 95 mole %, preferably 98 mole % of alkyl groups originating from the polymerization of ethylene.

M is an alkaline earth metal selected of the group consisting of calcium, barium, magnesium, strontium. Calcium and magnesium are the preferred alkaline earth metal. Calcium is more preferred. Wherein y and z are independently whole or partial integers.

The —COOM group of Formula can be in the ortho, meta or para position with respect to the hydroxyl group, wherein the ortho position is preferred in one aspect. The $R_a$ group can be in the ortho, meta or para position with respect to the hydroxyl group.

The alkaline earth metal alkylhydroxybenzoates of the present invention can be any mixture of alkaline-earth metal alkylhydroxybenzoic acid having the —COOM group in the ortho, meta or para position.

The alkaline earth metal alkylhydroxybenzoates of the present invention are generally soluble in oil as characterized by the following test: A mixture of a 600 Neutral diluent oil and the alkylhydroxybenzoate at a content of 10 wt % with respect to the total weight of the mixture is centrifuged at a temperature of 60° C. and for 30 minutes, the centrifugation being carried out under the conditions stipulated by the standard ASTM D2273 (it should be noted that centrifugation is carried out without dilution, i.e. without adding solvent); immediately after centrifugation, the volume of the deposit which forms is determined; if the deposit is less than 0.05% v/v (volume of the deposit with respect to the volume of the mixture), the product is considered as soluble in oil.

Hydroxybenzoic acids are typically prepared by the carboxylation, by the Kolbe-Schmitt process, from phenoxides, and in that case, will generally be obtained (normally in a diluent) in admixture with uncarboxylated phenol. Hydroxybenzoic acids may be non-sulphurized or sulphurized, and may be chemically modified and/or contain additional substituents. Processes for sulphurizing a hydrocarbyl-substituted hydroxybenzoic acid are well known to those skilled in the art, and are described, for example, in US Patent Application No. 2007/0027057.

The term "overbased" is generally used to describe metal detergents in which the metal ratio, the ratio of the number of equivalents of the metal moiety to the number of equivalents of the acid moiety, is greater than one. The term 'low-based' is used to describe metal detergents in which the metal ratio is greater than 1, and up to about 2.5.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole % of the cations, in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents may also be expressed as a total base number (TBN). A total base number is a measure of the alkalinity of the overbased material. It is expressed as mg of KOH/g of material. The TBN may be measured using ASTM standard D2896 or an equivalent procedure. The detergent may have a neutral TBN (i.e. a TBN of less than 100), a medium TBN (i.e. a TBN of 100 to 250) or a high TBN (i.e. a TBN of greater than 250, such as 250-500).

Overbased metal hydrocarbyl-substituted hydroxybenzoates can be prepared by any of the techniques employed in the art. A general method is as follows: 1. Neutralization of hydrocarbyl-substituted hydroxybenzoic acid with a molar excess of metallic base to produce a slightly overbased metal hydrocarbyl-substituted hydroxybenzoate complex, in a solvent mixture consisting of a volatile hydrocarbon, an alcohol and water; 2. Carbonation to produce colloidally-dispersed metal carbonate followed by a post-reaction period; 3. Removal of residual solids that are not colloidally dispersed; and 4. Stripping to remove process solvents.

Overbased metal hydrocarbyl-substituted hydroxybenzoates can be made by either a batch or a continuous overbasing process.

Metal base (e.g. metal hydroxide, metal oxide or metal alkoxide), preferably lime (calcium hydroxide), may be charged in one or more stages. The charges may be equal or may differ, as may the carbon dioxide charges which follow them. When adding a further calcium hydroxide charge, the carbon dioxide treatment of the previous stage need not be complete. As carbonation proceeds, dissolved hydroxide is converted into colloidal carbonate particles dispersed in the mixture of volatile hydrocarbon solvent and non-volatile hydrocarbon oil.

Carbonation may be effected in one or more stages over a range of temperatures up to the reflux temperature of the alcohol promoters. Addition temperatures may be similar, or different, or may vary during each addition stage. Phases in which temperatures are raised, and optionally then reduced, may precede further carbonation steps.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 mm2/sec at 38° C. are very suitable.

After the final treatment with carbon dioxide, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after solvent removal.

The products are generally used as an oil solution. If the reaction mixture contains insufficient oil to retain an oil solution after removal of the volatiles, further oil should be added. This may occur before, or at an intermediate point, or after solvent removal.

Advantageously, the TBN of the middle overbased alkaline earth metal alkylhydroxybenzoate of the present invention, the TBN is from about 100 to 250, preferably from about 140 to 230 and will generally have less than 1 volume %, preferably less than 0.5 volume % crude sediment. In this regard, the middle overbased alkaline earth metal alkylhydroxybenzoate of the present invention may be a single detergent or a mixture. In one aspect, a lower TBN from about (140-175) having a metal ratio of less than 3.0, preferably less than 2.5 is employed; in this regard, preferred alkyl chains are derived from linear alpha olefins having from 14 to 18 carbon atoms. In another aspect, a second middle overbased alkaline earth metal alkylhydroxybenzoate may be employed (with or in lieu of the lower TBN material) having a TBN from about (200-240) having a metal ratio of greater than 4.0 is employed; in this regard, preferred alkyl chains are derived from linear alpha olefins having from 20 to 28 carbon atoms. For the high overbased alkaline earth metal alkylhydroxybenzoate of the present invention is greater than 250, preferably from about 250 to 450 and more preferably from about 300 to 400 and will generally have less than 3 volume %, preferably less than 2 volume % and more preferably less than 1 volume % crude sediment. This higher TBN material will have a metal ratio greater than 6, preferable about 8; in this regard, preferred alkyl chains are derived from linear alpha olefins having from 20 to 28 carbon atoms.

In addition to the one or more overbased metal hydrocarbyl-substituted hydroxybenzoates described herein above, an addition suitable detergent may be selected from the slate of typical lubricating oil detergents; and as used herein it is distinct and different from the first detergent. Common examples of metal detergents included: sulfonates, alkylphenates, sulfurized alkyl phenates, carboxylates, salicylates, phosponates, and phosphinates. Overbased metal sulfonates are generally produced by carbonating a mixture of hydrocarbons, sulfonic acid, metal oxide or hydroxides (for example calcium oxide or calcium hydroxide) and promoters such as xylene, methanol and water. For example, for preparing an overbased calcium sulfonate; in carbonation, the calcium oxide or hydroxide reacts with the gaseous carbon dioxide to form calcium carbonate. The sulfonic acid is neutralized with an excess of CaO or Ca(OH), to form the sulfonate. The prior art known processes for overbasing calcium sulfonates generally produces high alkaline reserves of TBN of 300 to 400 mg KOH/gm or higher. Commercially available high TBN, up to approximately 400 TBN sulfonates, have enabled the formulator to use lower amounts of acid neutralizing additive while maintaining equivalent detergency, thus protecting the engine adequately under conditions of high acid formation in the combustion process. One aspect discloses that employing high TBN sulfonates (greater that 400 TBN, metal ratio 16 or greater) with the lower metal ratio overbased alkaline earth metal alkylhydroxybenzoate, in an automobile crankcase engine oil formulation can lead to improvements in fuel economy.

Also included within the meaning of "sulfonate" are the salts of sulfonic acids of synthetic alkyl aryl compounds, which often are preferred. These acids also are prepared by treating an alkyl aryl compound with sulfuric acid or sulfur trioxide. At least one alkyl substituent of the aryl ring is an oil-solubilizing group, as discussed above. The acids thus obtained are known as synthetic alkyl aryl sulfonic acids and the salts as alkyl aryl sulfonates. The sulfonates where the alkyl is straight-chain are the well-known linear alkylaryl sulfonates. Typically these obtained by the olio-polymerization of ethylene to $C_{14}$ to $C_{40}$ hydrocarbons followed by alkylation via a Friedel and Craft reaction of an aryl hydrocarbon. Branched olefins can be obtained from the oligo-polymerization of for example, propylene to $C_{15}$ to $C_{42}$ hydrocarbons and particularly the propylene tetrapolymer dimerized to a $C_{24}$ olefin, or alkylation of aromatics using normal alpha olefins. Preferred aryl groups are phenyl and substituted phenyl, preferably tolyl, xylyl, particularly ortho xylyl, ethyl phenyl, cumenyl and the like.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. The sulfonates are then overbased and such overbased materials and methods of preparing such materials are known to those skilled in the art. See, for example, LeSuer U.S. Pat. No. 3,496,105, issued Feb. 17, 1970, particularly Cols. 3 and 4.

The sulfonates are present in the lubricating oil composition in the form of alkaline earth metal salts, or mixtures thereof. The alkaline earth metals include magnesium, calcium and barium, of which calcium is preferred. The sulfonates are superalkalinized employing excess alkaline metal base carbon dioxide or other suitable base source. Often this is added sequentially or step wise addition with or without a promoter, paying particular attention to the overbasing process since improper overbasing will lead to highly viscous sulfonates or lower overbased than desired.

Particularly preferred, however, because of their wide availability, are salts of the petroleum sulfonic acids, particularly the petroleum sulfonic acids which are obtained by sulfonating various hydrocarbon fractions such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid which may or may not be alkylated; and the like.

The preferred salts for use in the present invention are those of alkylated aromatic sulfonic acids in which the alkyl radical or radicals contain at least about 8 carbon atoms, for example from about 8 to 40 carbon atoms. Another preferred group of sulfonate starting materials are the aliphatic-substituted cyclic sulfonic acids in which the aliphatic substituents or substituents contain a total of at least 12 carbon atoms, such as the alkyl aryl sulfonic acids, alkyl cycloaliphatic sulfonic acids, the alkyl heterocyclic sulfonic acids and aliphatic sulfonic acids in which the aliphatic radical or radicals contain a total of at least 12 carbon atoms. Specific examples of these oil-soluble sulfonic acids include petroleum sulfonic acid, petrolatum sulfonic acids, mono- and poly-wax-substituted naphthalene sulfonic acids, substituted sulfonic acids, such as cetyl benzene sulfonic acids, cetyl phenyl sulfonic acids, and the like, aliphatic sulfonic acid, such as paraffin wax sulfonic acids, hydroxy-substituted paraffin wax sulfonic acids, etc., cycloaliphatic sulfonic acids, petroleum naphthalene sulfonic acids, cetyl cyclopentyl sulfonic acid, mono- and poly-wax-substituted cyclohexyl sulfonic acids, and the like. The term "petroleum sulfonic acids" is intended to cover all natural sulfonic acids that are derived directly from petroleum products. Typical Group II metal sulfonates suitable for use in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc.

Also preferred are synthetic alkylaryl sulfonates. Particularly useful are synthetic alkylaryl sulfonates having the aryl sulfonate attached at the 1 or 2 position of the alkyl group, preferably greater than 5 mole %, more preferably greater than 13 mole % and more preferably greater than 20 mole %, as these have shown good compatibility and solubility while not forming a skin at these levels of overbasing. Preferred are linear monoalkyl sulfonates. Preferably the alkyl chain contains between 14 and 40 carbons and more preferably the alkylaryl sulfonate is derived from a $C_{14}$-$C_{40}$ normal alpha olefin and more particularly from a $C_{20}$-$C_{28}$ or a $C_{20}$-$C_{24}$ normal alpha olefin. In this regard, the alkyaryl sulfonate derived from a $C_{20}$-$C_{28}$ or a $C_{20}$-$C_{24}$ normal alpha olefin and is overbased to have a high TBN (i.e. a TBN of greater than 250, such as 250-500), preferably with a metal ratio greater or equal to 8, preferably 10-20, more preferably 16-18.

Mixtures of high TBN sulfonates can be employed including mixtures of natural sulfonates and synthetic sulfonates, mixtures of synthetic sulfonates such as mixtures of monoalkyl and dialkyl sulfonates, mixtures of monoalkyl and polyalkyl sulfonates or mixtures of dialkyl and polyalkyl sulfonates.

Lubricating Oil Composition

The present invention also relates to lubricating oil compositions containing the hydrocarbyl diol and the overbased alkylated hydroxyaromatic carboxylate detergent mixtures of the present invention. Such lubricating oil compositions will comprise a major amount of a base oil of lubricating viscosity and a minor amount of the hydrocarbyl diol and overbased alkylated hydroxyaromatic carboxylate detergent mixtures of the present invention.

Base oil as used herein is defined as a base stock or blend of base stocks which is a lubricant component that is produced by a single manufacturer to the same specifications (independent of feed source or manufacturer's location); that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100° C. and about 4 centistokes (cSt) to about 20 cSt. Hydrocarbon synthetic oils may include, for example, oils prepared from the polymerization of ethylene, polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity about 20 cSt or higher at about 100° C. Oils used as the base oil will be selected or blended depending on the desired end use and the additives in the finished oil to give the desired grade of engine oil, e.g. a lubricating oil composition having an SAE Viscosity Grade of 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

In one aspect, the present invention is directed to the use of lower viscosity grades. Recent improvements in the engine hardware and manufacturing have allowed for the opportunity to use lower viscosity grades in vehicles while maintaining durability and provided new and increased demand for fuel economy. Herein these are referred to as to ultra-low viscosity passenger car engine oil compositions.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Group III base oils are preferred, also are mixtures of Group II/III and mixtures of Group III/IV.

Commonly mixtures of base oils may be employed. Group II base stocks contain greater than or equal to 90 percent saturates; less than or equal to 0.03 percent sulfur; and a viscosity index greater than or equal to 80 and less than 210. Manufacturing plants that make Group II base stocks typically employ hydroprocessing such as hydrocracking or severe hydrotreating to increase the VI of the crude oil to the specifications value. The use of hydroprocessing typically increases the saturate content above 90% and reduces the sulfur below 300 ppm. Group II base stocks useful in the current inventions have a kinematic viscosity at 100° C. of about 2 to 14 cSt.

Group III base stocks contain greater than or equal to 90 percent saturates; less than or equal to 0.03 percent sulfur; and a viscosity index greater than or equal to 120. Group III base stocks are usually produced using a three-stage process involving hydrocracking an oil feed stock, such as vacuum gas oil, to remove impurities and to saturate all aromatics which might be present to produce highly paraffinic lube oil stock of very high viscosity index, subjecting the hydrocracked stock to selective catalytic hydrodewaxing which converts normal paraffins into branched paraffins by isomerization followed by hydrofinishing to remove any residual aromatics, sulfur, nitrogen or oxygenates. Group III base stocks useful in the current inventions have a kinematic viscosity at 100° C. of about 3 to 9 cSt.

Group IV low viscosity base oils may be incorporated into the formulations.

One aspect is directed to low viscosity passenger car engine oil compositions with a kinematic viscosity at 100° C. of from 3 to 9.3 cSt, more preferably wherein the composition has a kinematic viscosity at 100° C. of from 3 to 8.2 cSt, a Noack volatility of less than 15% as determined by ASTM D5800, a CCS viscosity of less than 5120 cP at −35° C. as determined by ASTM D5293, and an HTHS viscosity of less than 2.9 mPa·s at 150° C. as determined by ASTM D4683, more preferably an HTHS viscosity of less than or equal to 2.6 mPa·s at 150° C. as determined by ASTM D4683. One aspect is directed to low viscosity passenger car engine wherein the oil compositions has a kinematic viscosity at 100° C. of from 4 to 6.9 cSt, a Noack volatility of less than 15% as determined by ASTM D5800, a CCS viscosity of less than 4820 cP at −35° C. as determined by ASTM D5293, and an HTHS viscosity of less than 2.6 mPa·s at 150° C. as determined by ASTM D4683.

Natural lubricating oils may include animal oils, vegetable oils (e.g., rapeseed oils, castor oils and lard oil), petroleum oils, mineral oils, and oils derived from coal or shale. Synthetic oils may include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from C.sub.5 to C.sub. 12 monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil composition of the present invention. A major amount of base oil as defined herein comprises 50 wt or more. Preferred amounts of base oil comprise from about greater than 50 wt % to 97 wt %, more preferably from about 60 wt % to 97 wt % and most preferably from about 80 wt % to 95 wt % of the lubricating oil composition. (When weight percent is used herein, it is referring to weight percent of the lubricating oil unless otherwise specified.)

The overbased alkylated hydroxyaromatic carboxylate (i.e., overbased alkali metal alkylhydroxybenzoate) and second detergent mixture system will be present in the lubricating oil composition will be in a minor amount compared to the base oil of lubricating viscosity. Generally, it will be in an amount from about 1 wt % to 25 wt %, preferably from about 2 wt % to 12 wt % and more preferably from about 3 wt % to 8 wt %, based on the total weight of the lubricating oil composition.

The hydrocarbyl diol is preferably an oil soluble organic friction modifier and typically is incorporated in the lubricating oil composition in an amount of from about 0.02 to 10.0 wt. % of the lubricating oil composition. Preferably, from 0.05 to 2.0, more preferably from 0.05 to 1.0 wt, more preferably from 0.1 to 0.5 wt. % of the friction modifier is used.

Other Additive Components

The following additive components are examples of components that can be favorably employed in combination with the lubricating additive of the present invention. These examples of additives are provided to illustrate the present invention, but they are not intended to limit it.

The Dispersant

The dispersant employed in the compositions of this invention can be ashless dispersants such as an alkenyl succinimide, an alkenyl succinic anhydride, an alkenyl succinate ester, and the like, or mixtures of such dispersants.

Ashless dispersants are broadly divided into several groups. One such group is directed to copolymers which contain a carboxylate ester with one or more additional polar function, including amine, amide, imine, imide, hydroxy carboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethy methacrylate copolymers and the like. Additionally, high molecular weight amides and polyamides or esters and polyesters such as tetraethylene pentamine, polyvinyl polysterarates and other polystearamides may be employed. Preferred dispersants are N-substituted long chain alkenyl succinimides.

Mono and bis alkenyl succinimides are usually derived from the reaction of alkenyl succinic acid or anhydride and alkylene polyamines. The actual reaction product of alkylene or alkenylene succinic acid or anhydride and alkylene polyamine will comprise the mixture of compounds including succinamic acids and succinimides. However, it is customary to designate this reaction product as a succinimide of the described formula, since this will be a principal component of the mixture. The mono alkenyl succinimide and bis alkenyl succinimide produced may depend on the charge mole ratio of polyamine to succinic groups and the particular polyamine used. Charge mole ratios of polyamine to succinic groups of about 1:1 may produce predominately mono alkenyl succinimide. Charge mole ratios of polyamine to succinic group of about 1:2 may produce predominately bis alkenyl succinimide.

These N-substituted alkenyl succinimides can be prepared by reacting maleic anhydride with an olefinic hydrocarbon followed by reacting the resulting alkenyl succinic anhydride with the alkylene polyamine. The alkenyl radical, is preferably derived from a polymer prepared from an olefin monomer containing from 2 to 5 carbon atoms. Thus, the alkenyl radical is obtained by polymerizing an olefin containing from 2 to 5 carbon atoms to form a hydrocarbon having a molecular weight ranging from about 450 to 3000. Such olefin monomers are exemplified by ethylene, propylene, 1-butene, 2-butene, isobutene, and mixtures thereof.

In a preferred aspect, the alkenyl succinimide may be prepared by reacting a polyalkylene succinic anhydride with an alkylene polyamine. The polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. EP 355 895; terpolymer PIBSA described in U.S. Pat. No. 5,792,729; sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863. The disclosures of each of these documents are incorporated herein by reference in their entirety. The polyalkylene succinic anhydride is preferably a polyisobutenyl succinic anhydride. In one preferred embodiment, the polyalkylene succinic anhydride is a polyisobutenyl succinic anhydride having a number average molecular weight of at least 450, more preferably at least 900 to about 3000 and still more preferably from at least about 900 to about 2300.

In another preferred embodiment, a mixture of polyalkylene succinic anhydrides are employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 450 to below 1000 and the high molecular weight component has a number average molecular weight of from 1000 to about 3000. Still more preferably, both the low and high molecular weight components are polyisobutenyl succinic anhydrides. Alternatively, various molecular weights polyalkylene succinic anhydride components can be combined as a dispersant as well as a mixture of the other above referenced dispersants as identified above.

The polyalkylene succinic anhydride can also be incorporated with the detergent which is anticipated to improve stability and compatibility of the detergent mixture. When employed with the detergent it can comprise from 0.5 to 5 percent by weight of the detergent mixture and preferably from about 1.5 to 4 weight percent.

The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl)imidazoline, 1-(2-aminopropyl)-piperazine, 1,4-bis(2-aminoethyl)piperazine and 2-methyl-1-(2-aminobutyl) piperazine. Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898-905 (Interscience Publishers, New York, 1950). The term "ethylene amine" is used in a generic sense to denote a class of polyamines conforming for the most part to the structure $H_2N(CH_2CH_2NH)_tH$ wherein t is an integer from 1 to 10. Thus, it includes, for example, ethylene diamine, diethylene triamine, triethylene tetraamine, tetraethylene pentamine, pentaethylene hexamine, and the like.

The individual alkenyl succinimides used in the alkenyl succinimide composition of the present invention can be prepared by conventional processes, such as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

Also included within the term "alkenyl succinimides" are post-treated succinimides such as post-treatment processes involving borate or ethylene carbonate disclosed by Wollenberg, et al., U.S. Pat. No. 4,612,132; Wollenberg, et al., U.S. Pat. No. 4,746,446; and the like as well as other post-treatment processes each of which are incorporated herein by reference in its entirety. Preferably, the carbonate-treated alkenyl succinimide is a polybutene succinimide derived from polybutenes having a molecular weight of 450 to 3000, preferably from 900 to 2500, more preferably from 1300 to 2300, and preferably from 2000 to 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912 incorporated herein by reference.

The alkenyl succinimide can be a modified alkenyl succinimide which is obtained by after-treatment using a boric acid, an alcohol, an aldehyde, a ketone, an alkylphenol, a cyclic carbonate, an organic acid, or the like. Preferable modified succinimides are borated alkenyl succinimides which are produced by after-treatment using boric acid or a boron-containing compound. The borated succinimides are preferred because of their high thermal and oxidation stability.

Preferably, the alkenyl succinimide component comprises from 1 to 20 weight percent, preferably 2 to 12 weight percent, and more preferably 4 to 8 weight percent of the weight of the lubricant composition. Suitable nitrogen containing dispersants may be employed in an amount within a range of 0.01 to 0.3 mass % in terms of nitrogen content.

Lubricating Oil and Lubricating Compositions

The lubricating oil compositions of the present invention can be conveniently prepared by simply blending or mixing hydrocarbyl diol and the overbased detergent mixtures of the present invention, with an oil of lubricating viscosity (base oil). The compounds of the invention may also be preblended as a concentrate or package with various other additives in the appropriate ratios to facilitate blending of a lubricating composition containing the desired concentration of additives. The compounds of the present invention are blended with base oil a concentration at which they provide improved fuel economy and are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about 20° C.–25° C.) can be measured by either actual precipitation from the oil composition or the formulation of a "cloudy" solution which evidences formation of insoluble wax particles.

The lubricating oil, or base oil, used in the lubricating oil compositions of the present invention are generally tailored to the specific use e.g. engine oil, gear oil, industrial oil, cutting oil, etc. For example, where desired as a crankcase engine oil, the base oil typically will be a mineral oil or synthetic oil of viscosity suitable for use in the crankcase of an internal combustion engine such as gasoline engines and diesel engines which include marine engines. Crankcase lubricating oils ordinarily have a viscosity of about 1300 cSt at 0° F. to 24 cSt at 210° F. (99° C.) the lubricating oils may be derived from synthetic or natural sources. Natural oils include animal oils and vegetable oils (e.g. castor oil, lard oil) as well as mineral oil. Mineral oil for use as the base oil in this invention includes paraffinic, naphthenic and other oils that are ordinarily used in lubricating oil compositions, including solvent treated, hydro treated or oils from Fisher-Tropsch processes. Preferred oils of lubricating viscosity used in this invention should have a viscosity index of at least 95, preferably at least 100. The preferred are selected from API Category oils Group I through Group IV and preferably from Group II, III and IV or mixtures thereof optionally blended with Group I. Synthetic oils include both hydrocarbon synthetic oils and synthetic esters. Useful synthetic hydrocarbon oils include liquid polymers of alpha olefins having the proper viscosity. Especially useful are the hydrogenerated liquid oligomers of $C_6$ to $C_{12}$ alpha olefins such as 1-decene trimer. Likewise, alkyl benzenes of proper viscosity such as didodecyl benzene can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used. Blends of various mineral oils, synthetic oils and minerals and synthetic oils may also be advantageous, for example to provide a given viscosity or viscosity range. In general the base oils or base oil mixtures for engine oil are preselected so that the final lubricating oil, containing the various additives, including the present fuel economy additive composition, has a viscosity at 100° C. of 4 to 22 centistokes.

Typically the lubricating oil composition will contain a variety of compatible additives desired to impart various properties to the finished lubricating oil composition depending on the particular end use and base oils used. Such additives include supplemental neutral and basic detergents such as natural and overbased organic sulfonates and normal and overbased phenates and salicylates, dispersants, and/or ashless dispersants. Also other additives such as antiwear agents, friction modifiers, rust inhibitors, foam inhibitors, pour point dispersants, antioxidants, including the so called viscosity index (VI) improvers, dispersant VI improvers and, as noted above, other corrosion or wear inhibitors.

Preferably a minor amount of antiwear agent, a metal dihydrocarbyl dithiophosphate is added to the lubricant composition. The metal is preferably zinc. The dihydrocarbyldithiophosphate may be present in amount of 0.1 to 2.0 mass percent but typically low phosphorous compositions are desired so the dihydrocarbyldithiophosphate is employed at a dosage of less than 0.1 mass % measured as phosphorus level in the lubricating oil composition. Preferably, zinc dialkylthiophosphate (ZDDP) is used. This provides antioxidant and antiwear properties to the lubricating composition. Such compounds may be prepared in accordance with known techniques by first forming a dithiophosphoric acid, usually by reaction of an alcohol or a phenol with P2S5 and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbinol (4-methyl-1-pentane-2-ol), 1-pentanol, 2-methyl butanol, and 2-methyl-1-propanol. The hydrocarbyl groups can be a primary, secondary, or mixtures thereof, e.g. the compounds may contains primary and/or secondary alkyl groups derived from primary or secondary carbon atoms. Moreover, when employed, there is preferably at least 50, more preferably 75 or more, most preferably 85 to 100, mass % secondary alkyl groups; an example is a ZDDP having 85 mass % secondary alkyl groups and 15 mass % primary alkyl groups, such as a ZDDP made from 85 mass % butan-2-ol and 15 mass % iso-octanol. Even more preferred is a ZDDP derived from derived from sec-butanol and methylisobutylcarbinol and most preferably wherein the sec-butanol is 75 mole percent.

The metal dihydrocarbyldithiophosphate provides most if not all, of the phosphorus content of the lubricating oil composition. Amounts are present in the lubricating oil composition to provide a phosphorus content, expressed as mass % elemental phosphorus, of 0.10 or less, preferably 0.08 or less, and more preferably 0.075 or less, such as in the range of 0.025 to 0.07.

Oxidation inhibitors or antioxidants reduce the tendency of base stocks to deteriorate in service, which deterioration can be evidenced by the products of oxidation such as sludge and varnish-like deposits on the metal surfaces and by viscosity growth. The lubricating oil composition of the present invention further contains, in an amount that is within a range of 0.1 to 7 mass %, at least one antioxidant selected from the group consisting of phenol compounds (phenol antioxidants), amine compounds (amine antioxidants), and molybdenum compounds (molybdenum antioxidants).

A hindered phenol compound is generally used as the phenol antioxidant, and a diaryl amine compound is generally used as the amine antioxidant. Hindered phenol antioxidants and diaryl amine antioxidants are both also effective in improving high-temperature detergency. Diaryl amine antioxidants in particular have a base value derived from nitrogen and are effective in improving high-temperature detergency. On the other hand, hindered phenol antioxidants are effective in preventing oxidative degradation.

Examples of hindered phenol antioxidants are 2,6-di-t-butyl-p-cresol, 4,4'-methylenebis(2,6-di-t-butylphenol), 4,4'-methylenebis(6-t-butyl-o-cresol), 4,4'-isoropylidenebis(2,6)-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thiodiethylenebis[3-(3,5-di-t-butyl-4-hydroxyphenyl)propionate], octyl 3-(3,5-di-t-butyl-4-hydroxyphenyl)propionate, octadecyl 3-(3,5-di-t-butyl-4-hydroxyphenyl)propionate, and octyl 3-(5-t-butyl-4-hydroxy-3-methylphenyl)propionate.

Examples of amine antioxidants are C4-9 mixed alkyl diphenyl amines, p,p'-dioctyldiphenylamine, phenyl-α-naphthylamine, phenyl-β-naphthylamine, alkylated-α-naphthylamine, and alkylated-phenyl-α-naphthylamine.

Examples of molybdenum antioxidants are oxymolybdenum complexes of basic nitrogen compounds. Examples of preferred oxymolybdenum complexes of basic nitrogen compounds are oxymolybdenum complexes of succinimide and oxymolybdenum complexes of carbonamide. Oxymolybdenum complexes of basic nitrogen compounds can be produced using the following method, for instance. A molybdenum complex is produced by reacting an acidic molybdenum compound or salt thereof with a basic nitrogen compound, such as a succinimide, carbonamide, hydrocarbon monoamine, hydrocarbon polyamine, Mannich hydrochloric acid, phosphonamide, thiophosphonamide, phosphoric amide, dispersion-type viscosity index-improving agent (or a mixture thereof), while maintaining the reaction temperature at 120° C. or lower.

Moreover, it is also possible to use a molybdenum-containing compound other than an oxymolybdenum complex of a basic nitrogen compound in place of the oxymolybdenum complex of the basic nitrogen compound, or in combination with the oxymolybdenum complex of a basic nitrogen compound. Examples of the combined molybdenum-containing compounds that can be used are sulfurized oxymolybdenum dithiocarbamates and sulfurized oxymolybdenum dithiophosphates.

The phenol antioxidant (particularly hindered phenol antioxidant), amine antioxidant (particularly diaryl amine antioxidant), and molybdenum antioxidant (particularly oxymolybdenum complex of basic nitrogen compound) can be used alone, or they can be used as an arbitrary combination with one another as desired. It is also possible to use these in combination with an oil-soluble antioxidant.

Additional friction modifiers optionally may be employed and may include such compounds as aliphatic amines or ethoxylated aliphatic amines, aliphatic fatty acid amides, aliphatic carboxylic acids, aliphatic carboxylic esters of polyols such as glycerol esters of fatty acid as exemplified by glycerol oleate, boric esters of glycerol fatty acid monoesters, aliphatic carboxylic ester-amides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Representative examples of suitable friction modifiers are found in U.S. Pat. No. 3,933,659 which discloses fatty acid esters and amides; U.S. Pat. No. 4,105,571 which discloses glycerol esters of dimerized fatty acids; U.S. Pat. No. 4,702,859 which discloses esters of carboxyclic acids and anhydrides with alkanols; U.S. Pat. No. 4,530,771 which is a preferred borated glycerol monooleate comprising esters constituted with a glycerol, fatty acid and a boric acid, said ester having a positive amount up to 2.0 moles of a carboxylic acid residue comprising a saturated or unsaturated alkyl group having 8 to 24 carbon atoms and 1.5 to 2.0 moles of a glycerol residue, both per unit mole of a boric acid residue on average of the boric esters used singly or in combination, molar proportion between said carboxylic acid residue and said glycerol residue being that the glycerol residue is 1.2 moles or more based on 1 mole of the carboxylic acid residue; U.S. Pat. No. 3,779,928 which discloses alkane phosphonic acid salts; U.S. Pat. No. 3,778,375 which discloses reaction products of a phosphonate with an oleamide; and U.S. Pat. No. 3,932,290 which discloses reaction products of di-(lower alkyl) phosphites and epoxides. The disclosures of the above references are herein incorporated by reference. Examples of nitrogen containing friction modifiers, include, but are not limited to, imidazolines, amides, amines, alkoxylated amines, alkoxylated ether amines, amine oxides, amidoamines, nitriles, betaines, quaternary amines, imines, amine salts, amino guanadine, alkanolamides, and the like. Such friction modifiers can contain hydrocarbyl groups that can be selected from straight chain, branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Preferred hydrocarbyl groups range from 12 to 25 carbon atoms and may be saturated or unsaturated. More preferred are those with linear hydrocarbyl groups.

Such friction modifier is preferably an oil soluble organic friction modifier incorporated in the lubricating oil composition in an amount of from about 0.02 to 2.0 wt. % of the lubricating oil composition. Preferably, from 0.05 to 1.0, more preferably from 0.1 to 0.5 wt. % of the friction modifier is used.

The lubricating composition of the present invention may also contain a viscosity index improver or VII. Viscosity Index Improver. Examples of the viscosity index improvers are poly-(alkyl methacrylate), ethylene-propylene copolymer, styrene-butadiene copolymer, and polyisoprene. Viscosity index improvers of dispersant type (having increased dispersancy) or multifunction type are also employed. These viscosity index improvers can be used singly or in combination. The amount of viscosity index improver to be incorporated into an engine oil varies with desired viscosity of the compounded engine oil, and generally in the range of 0.5-20 wt. % per total amount of the engine oil.

The engine oil compositions have outstanding Noack volatilities, as determined by ASTM D5800. Preferably, the Noack volatility of the engine oil composition is less than wt % loss, less than 13 wt % loss, or less than 11 wt % loss.

The engine oil compositions have outstanding CCS viscosities at −35° C., as determined by ASTM D5293. Preferably, the CCS viscosity of the engine oil composition is less than 5200 mPa·s, less than 5000 mPa·s, less than 4000 mPa·s, less than 3800 mPa·s, less than 3500 mPa·s, less than 3000 mPa·s, or less than 2500 mPa·s.

The engine oil compositions have outstanding high-temperature, high-shear (HTHS) viscosities at 150° C., as determined by ASTM D4683. Preferably, the HTHS viscosity of the engine oil composition at 150° C. is less than 2.9 mPa·s, less than 2.6 mPa·s, less than 2.4 mPa·s, less than 2.3 mPa·s, less than 2.0 less than mPa·s, 1.9 mPa·s, less than 1.8 mPa·s, or less than 1.5 mPa·s.

The following examples are presented to illustrate specific embodiments of this invention and are not to be construed in any way as limiting the scope of the invention.

EXAMPLES

The invention will be further illustrated by the following examples, which set forth particularly advantageous embodiments. The type and quantities of performance additives used in combination with the instant invention in lubricating oil compositions are not limited but the examples shown herein as illustrations.

Examples 1-4 and Comparative Examples A-D

Lubricating oil compositions were prepared by adding the below mentioned additive components to the base oil to give the formulations set forth in Tables 1 and 2. The lubricating oil compositions for Examples 1-4 are according to the invention, while Comparative Examples A-D are offered as comparison and are not of the invention. Examples 1-3 and Comparative Examples A-C were formulated targeting an SAE viscosity grade of 0W-20 (as defined in SAE J300, January 2009 version). They have a kinematic viscosity of 7.7-7.8 $mm^2/s$ at 100° C. Example 4 and Comparative Example D were formulated targeting an SAE viscosity grade of 0W-4. They have a kinematic viscosity of 3.1 $mm^2/s$ at 100° C.

Base Oil— a) Examples 1-3 and Comparative Examples A-C: Mineral base oil (kinematic viscosity for 4.2 $mm^2/s$ at 100° C., viscosity index of 130) prepared via vacuum distillation, isodewaxing and hydrofinishing.

b) Example 4 and Comparative Example D: Mineral base oil (kinematic viscosity for 3.1 $mm^2/s$ at 100° C., viscosity index of 112) prepared via vacuum distillation, isodewaxing and hydrofinishing.

Additives:

Dispersant—Ashless, nitrogen containing, succinimide dispersant with nitrogen content of 1.0 wt %

Metal Containing Detergent— a) Overbased alkaline earth metal alkylhydroxybenzoate A: Calcium with TBN of 170 and metal ratio of 2.3, C14-18 alkyl groups b) Overbased alkaline earth metal alkylhydroxybenzoate B: Calcium with TBN of 230 and metal ratio of 4.0, C20-28 alkyl groups c) Overbased alkaline earth metal alkylhydroxybenzoate C: Calcium with TBN of 320 and metal ratio of 8.0, C20-28 alkyl groups d) Overbased Sulfonate A: Calcium sulfonate with TBN of 425 and metal ratio of 17.9, C20-28 alkyl groups e) Low Overbased Sulfonate B: Calcium sulfonate with TBN of 17 and metal ratio of 1.5, C20-28 alkyl groups Friction Modifier— a) FM A: Vicinal diol friction modifier made from a mixture of 16 and 18 carbon alpha olefins b) FM B: Borated glycerol monooleate friction modifier Zinc Wear Inhibitor—Mixture of zinc dialkyldithiophosphates Oxidation Inhibitor—Mixture of diphenylamine based aminic antioxidant and a molybdenum succinimide complex with Mo=5.5 wt %, S=0.2 wt %, N=1.6 wt %

Viscosity Index Improver—Polymethacrylate viscosity index improver used in 0W-20 formulations. No VII was used in 0W-4 oils.

HFRR Friction Test

The friction performance of the lubricating oil compositions of Examples 1-3 was evaluated using a High Frequency Reciprocating Rig (HFRR), and compared to the friction performance of the lubricating oil composition of Comparative Examples A-C.

The HFRR test rig is an industry recognized tribometer for determining lubricant performance. The PCS instrument uses an electromagnetic vibrator to oscillate a specimen (the ball) over a small amplitude while pressing it against a fixed specimen (a flat disk). The amplitude and frequency of the oscillation and the load are variable. The frictional force between the ball and flat and the electrical contact resistance (ECR) are measured. The flat, stationary specimen is held in a bath, to which the lubricating oil is added, and can be heated. In this method, a 2 mL sample is placed in the test reservoir of an HFRR and adjusted to a standard temperature. When the sample temperature has stabilized, a vibrator arm holding a non-rotating steel ball is lowered until it contacts a test disk completely submerged in the sample. The ball is caused to rub against the disk. For this test, the tribometer was set up to run at 20 Hz for 60 minutes, using 6 mm ball on flat specimens of 52100 steel. The load was 1 kg and temperature was 120° C. In this test, a smaller coefficient of friction corresponds to less friction between the ball and disk. The formulations for Examples 1-3 and Comparative Examples A-C and their respective HFRR friction performance data are presented in Table 1.

TABLE 1

HFRR Friction Performance

| | Example 1 | Example 2 | Example 3 | Comp. A | Comp. B | Comp. C |
|---|---|---|---|---|---|---|
| Dispersant | 300 ppm N | 300 ppm N | 300 ppm N | 300 ppm N | 300 ppm N | 300 ppm N |
| Overbased calcium alkylhydroxybenzoate A MR = 2.3 | 0.96 | 0.96 | 0.96 | 2.9 | | 2.9 |
| Overbased calcium alkylhydroxybenzoate B MR = 4.0 | | | 0.49 | | | |
| Overbased calcium alkylhydroxybenzoate C MR = 8.0 | | 1.1 | 0.70 | | | |
| Sulfonate A MR = 17.9 | 0.76 | | | | 1.0 | |
| Sulfonate B | 0.77 | 0.77 | 0.77 | 0.77 | 0.77 | 0.77 |
| ZnDTP | 770 ppm P | 770 ppm P | 770 ppm P | 770 ppm P | 770 ppm P | 770 ppm P |
| Oxidation Inhibitor | 1.6 | 1.6 | 1.6 | 1.6 | 1.6 | 1.6 |
| FM A | 1.0 | 1.0 | 1.0 | 1.0 | 1.0 | 0 |
| Friction | 0.095 | 0.095 | 0.094 | 0.099 | 0.100 | 0.114 |

Unless otherwise indicated all additive values are given as weight percent of the fully formulated oil. Dispersant values are given as ppm of nitrogen supplied by the dispersant. ZnDTP levels are indicated as ppm phosphorus from the ZnDTP.

The test results set forth in Table 1 indicate that the lubricating compositions formulated according to the invention show improved frictional performance over those of Comparative Examples A-C.

Motored Friction Torque Test

A motored friction torque test was used to evaluate the frictional performance under boundary lubrication conditions of Example 4 and Comparative Example D.

The crank shaft of a gasoline engine (inline 4-cylinder engine, 1.8 L, roller type valve system) was rotated by means of an electric motor connected via a torque meter and the running torque was monitored. The oil temperature was maintained at 100° C. The test was carried out at a rotational rate of 550 rpm for 150 seconds. The torques were continuously monitored during the period from 30 seconds after start of test to 120 seconds. An average torque value was calculated from the monitored torque values. Independently, a reference oil (SAE viscosity grade 0W-20, kinematic viscosity at 100° C. of 8.9 $mm^2/s$) was prepared. Percentage of change in frictional torque, for Example 4 and Comparative Example D were calculated using the 0W-20 average torque value as a reference. The formulations of Example 4 and Comparative Example D as well as their percent change in frictional torque with regards to the 0W-20 reference oil are presented in Table 2.

TABLE 2

Motored Frictional Torque Test

| | Example 4 | Comp. D |
|---|---|---|
| Dispersant | 300 ppm N | 300 ppm N |
| Overbased calcium alkylhydroxybenzoate A MR = 2.3 | 0.96 | 0.96 |
| Overbased calcium alkylhydroxybenzoate B MR = 4.0 | 0.49 | 0.49 |
| Overbased calcium alkylhydroxybenzoate C MR = 8.0 | 0.70 | 0.70 |
| Sulfonate B | 0.77 | 0.77 |
| ZnDTP | 770 ppm P | 770 ppm P |
| Oxidation Inhibitor | 1.6 | 1.6 |
| FM A | 1.0 | 0 |
| FM B | 0 | 1.0 |
| % Change | −2.2 | 2.9 |

Unless otherwise indicated all additive values are given as weight percent of the fully formulated oil. Dispersant values are given as ppm of nitrogen supplied by the dispersant. ZnDTP levels are indicated as ppm phosphorus from the ZnDTP.

The test results set forth in Table 2 indicate that the lubricating composition formulated according to the invention shows improved frictional performance under boundary conditions over that of Comparative Example D. Comparative Example D, formulated with a borated glycerol monooleate friction modifier shows increased friction over the 0W-20 reference oil. Example 4 formulated with the friction modifier and detergent system of the invention shows decreased friction.

What is claimed is:

1. An internal combustion engine lubricating oil composition comprising:

a. a major amount of mineral base oil of lubricating viscosity, wherein the mineral base oil of lubricating viscosity has a viscosity index of greater than 110;

b. 0.5 to 1.5 wt % of a friction modifier which is selected from the group consisting of $C_{12}$-$C_{28}$ alkane 1,2-diols and $C_{12}$-$C_{28}$ alkene 1,2-diols;

c. 0.5 to 2.0 wt % of an overbased alkyl hydroxybenzoate detergent having a metal ratio of greater than 1.0 to less than 3.0; and d. 0.38 to 1.52 wt % of an overbased alkyl calcium sulfonate having a metal ratio of greater than 10 to 25, or 0.25 to 2.2 wt % of an overbased alkyl calcium hydroxybenzoate having a metal ratio of greater than 2.0 to 10;

wherein the internal combustion engine lubricating oil composition has a HTHS viscosity of less than 2.6 mPa·s at 150° C. as determined by ASTM D4683.

2. The internal combustion engine lubricating oil composition according to claim 1, wherein the friction modifier is selected from the formula $R_1$—CH(OH)$CH_2$(OH) wherein $R_1$ is alkyl containing from 10 to 26 carbon atoms.

3. The internal combustion engine lubricating oil composition according to claim 1, wherein the friction modifier is a $C_{12}$-$C_{28}$ alkane 1,2-diol derived from a linear alkyl containing from 14 to 18 carbon atoms.

4. The internal combustion engine lubricating oil composition according to claim 3, wherein the friction modifier is in amount from 0.5 to 2.0 wt. % based upon the total weight of the lubricating oil composition.

5. The internal combustion engine lubricating oil composition according to claim 1, wherein the overbased alkyl calcium hydroxybenzoate detergent having a metal ratio of greater than 1.0 to less than 3.0 has an alkyl chain length of 14 to 18 carbon atoms.

6. The internal combustion engine lubricating oil composition according to claim 1, wherein the overbased alkyl calcium sulfonate having a metal ratio of greater than 10 to 25, has an alkyl chain length of 20 to 28 carbon atoms.

7. The internal combustion engine lubricating oil composition according to claim 1, wherein the overbased alkyl calcium hydroxybenzoate having a metal ratio of greater than 2.0 to 10, has an alkyl chain length of 20 to 28 carbon atoms.

8. The internal combustion engine lubricating oil composition according to claim 1, wherein the lubricating oil composition is formulated to meet SAE viscosity grade 0W20.

9. The internal combustion engine lubricating oil composition according to claim 1, wherein the lubricating oil composition has a HTHS viscosity of less than 2.3 mPa·s at 150° C. as determined by ASTM D4683.

10. The internal combustion engine lubricating oil composition according to claim 1, wherein the lubricating oil composition contains less than 3 wt % of viscosity index improver component.

11. A method for reducing friction in an internal combustion engine comprising lubricating said engine with a lubricating oil composition comprising:

a. a major amount of mineral base oil of lubricating viscosity, wherein the mineral base oil of lubricating viscosity has a viscosity index of greater than 110;

b. 0.5 to 1.5 wt % of a friction modifier which is selected from the group consisting of $C_{12}$-$C_{28}$ alkane 1,2-diols and $C_{12}$-$C_{28}$ alkene 1,2-diols;

c. 0.5 to 2.0 wt % of an overbased alkyl hydroxybenzoate detergent having a metal ratio of greater than 1.0 to less than 3.0; and d. 0.38 to 1.52 wt % of an overbased alkyl calcium sulfonate having a metal ratio of greater than 10 to 25, or 0.25 to 2.2 wt % of an overbased alkyl calcium hydroxybenzoate having a metal ratio of greater than 2.0 to 10, wherein the internal combustion engine lubricating oil composition has a HTHS viscosity of less than 2.6 mPa·s at 150° C. as determined by ASTM D4683.

* * * * *